US006609396B2

(12) United States Patent
Morita et al.

(10) Patent No.: US 6,609,396 B2
(45) Date of Patent: Aug. 26, 2003

(54) WEFT KNITTING MACHINE WITH TRANSFERRING MECHANISM AND TRANSFERRING METHOD

(75) Inventors: Toshiaki Morita, Wakayama (JP); Takekazu Shibuta, Wakayama (JP)

(73) Assignee: Shima Seiki Mfg., Ltd., Wakayama (JP)

( * ) Notice: Subject to any disclaimer, the term of this patent is extended or adjusted under 35 U.S.C. 154(b) by 0 days.

(21) Appl. No.: 10/239,020

(22) PCT Filed: Mar. 26, 2001

(86) PCT No.: PCT/JP01/02434

§ 371 (c)(1),
(2), (4) Date: Sep. 18, 2002

(87) PCT Pub. No.: WO01/86048

PCT Pub. Date: Nov. 15, 2001

(65) Prior Publication Data

US 2003/0033836 A1 Feb. 20, 2003

(30) Foreign Application Priority Data

Mar. 30, 2000 (JP) ..... 2000-94043

(51) Int. Cl.[7] ..... D04B 7/00
(52) U.S. Cl. ..... 66/64; 66/148
(58) Field of Search ..... 66/147, 148, 120, 66/69, 66, 61, 64, 60 R

(56) References Cited

U.S. PATENT DOCUMENTS 4,905,483 A * 3/1990 Shima ..... 66/64
5,398,527 A 3/1995 Hirai et al.
5,636,532 A * 6/1997 Shima et al. ..... 66/64
5,992,184 A * 11/1999 Shibuta ..... 66/64
6,047,569 A * 4/2000 Shima ..... 66/64
6,079,231 A * 6/2000 Shima ..... 66/64
6,109,067 A * 8/2000 Shibuta ..... 66/64
6,381,992 B1 * 5/2002 Haltenhof ..... 66/64

FOREIGN PATENT DOCUMENTS

EP 955402 11/1999
JP 3000461 11/1999

* cited by examiner

*Primary Examiner*—Danny Worrell
(74) *Attorney, Agent, or Firm*—Rothwell, Figg, Ernst & Manbeck

(57) ABSTRACT

A flat knitting machine comprising a transfer jack bed (9) holding transfer jacks (7) in such a manner as to freely advance and retract, wherein when a loop is transferred from the transfer jack (7) to the needle (19), the loop retaining portion (53) of the transfer jack (7) put in its advanced position is moved down to its lowered position, first; then, a back side (39*b*) of a needle hook of the needle (19) is made to go into the loop (111) retained on the loop retaining portion (53) of the transfer jack (7); then the loop retaining portion (53) is raised up to its raised position; and thereafter, a front side (39*a*) of the needle hook of the needle is made to go into the loop, whereby the transfer of loop can be ensured with a reduced burden on the loop in the transfer of loop through the use of a common track for the needles of the front bed (13*a*) and for the needles of the back bed (13*b*).

5 Claims, 8 Drawing Sheets

WEFT KNITTING MACHINE WITH TRANSFERRING MECHANISM AND TRANSFERRING METHOD

CROSS REFERENCE TO RELATED APPLICATION

This application is a 35 USC 371 National Phase Entry Application from PCT/JP01/02434, filed Mar. 26, 2001, and designating the U.S.

TECHNICAL FIELD

The present invention relates to a flat knitting machine comprising a transfer jack bed (hereinafter it is referred to as "TR jack bed") in which a number of transfer jacks (hereinafter they are referred to as "TR jack") each having a loop retaining portion at a front end thereof are implanted and which is arranged over needle beds, and a transfer cam mechanism for transferring the loop between the TR jacks of the TR jack bed and the needles of the needle beds, and to a loop transfer method.

BACKGROUND ART

A flat knitting machine comprising a pair of front and back needle beds holding needles in such a manner as to be advanced and retracted in needle grooves formed on upper surfaces of the needle beds, at least one of which is movable horizontally with respect to the other needle bed, and at least one transfer jack bed located over the at least one needle bed and holding transfer jacks in such a manner as to freely advance and retract in the grooves formed on an upper surface thereof is disclosed by Japanese Patent No. 2794144. In the flat knitting machine disclosed in this publication, the TR jack bed and the needle beds are so structured that they can be racked longitudinally relative to each other to transfer a loop between the needles of the front and back needle beds and between the needle of the needle bed and the TR jack of the TR jack bed. This flat knitting machine thus structured enables a loop retained by the needle of the needle bed to be transferred to an adjacent needle of the same needle bed by transferring the loop retained by the needle of the needle bed to the TR jack of the TR jack bed, first; then racking the TR jack bed; and then transferring the loop retained by the TR jack to the adjacent needle of the needle bed.

When the TR jack bed and the needle bed are racked relative to each other in the state in which the loop transferred from the needle to the TR jack is kept retained by the TR jack, upper and lower yarn portions of the loop retained by the loop retaining portion of the TR jack are pulled in the racking direction. As the racking distance increases, the distance between the upper and lower yarn portions of the loop decreases and resultantly the space in the loop for the needle to be advanced into becomes narrower. As a result of this, there arises the drawback that the needle hook to be advanced into the loop may collide with the upper and lower yarn portions of the loop to cause possible yarn breakage or stitch drop. Although the space in the loop for the needle to be advanced into can be widened by increasing thickness of the loop retaining portion of the TR jack with respect to a height direction thereof, there could then arise another drawback that when fine loops are formed in knitting, a burden is placed on the loops to cause possible yarn breakage.

For solving the problem noted above, the applicant of this application previously proposed a flat knitting machine disclosed in Japanese Laid-open (Unexamined) Patent Publication No. Hei 11 (1999)-323703. In the flat knitting machine disclosed by Japanese Laid-open (Unexamined) Patent Publication No. Hei 11 (1999)-323703, when the needle is advanced into the loop retained by the TR jack, to transfer the loop from the TR jack to the needle, the TR jack is advanced and retracted horizontally so that when a back side of the needle hook is advanced into the loop, the TR jack is moved in the direction in which the loop is moved to the back side of the needle hook, while on the other hand, when a front side of the needle hook is advanced into the loop, the TR jack is moved in the direction in which the loop is moved to the front side of the needle hook.

In the flat knitting machine disclosed by Japanese Laid-open (Unexamined) Patent Publication No. Hei 11 (1999)-323703, when the loop is transferred between the TR jack bed and the needle bed immediately under the TR jack bed, the TR jack bed is advanced to a position beyond a center line of a needle bed gap once and then is retracted to a position on the center line of the needle bed gap, so that the needle hook is advanced into the loop on the loop retaining portion of the TR jack. After that, when the loop is transferred between the TR jack bed and the back needle bed confronting it across the needle bed gap, the TR jack is retracted from the center line of the needle bed gap once and then is put back to the position on the center line of the needle bed gap, so that the needle hook is advanced into the loop. In the flat knitting machine disclosed by Japanese Laid-open (Unexamined) Patent Publication No. Hei 11 (1999)-323703, in order for the needle hooks to be advanced into the loops, a track for the TR jacks for the needles of the front needle bed and a track for the TR jacks for the back needle bed are separately provided in carriages. This enables the space in the loop for the needle to be advanced into to be widened without any need to increase the thickness of the loop retaining portion of the TR jack with respect to a height direction thereof.

It is the object of the present invention to disclose a flat knitting machine that can provide a reliable transfer of loop with a reduced burden on the loop in the transfer of loop using a common track for the needles of the front needle bed and for the needles of the back needle bed, and a loop transfer method.

DISCLOSURE OF THE INVENTION

In order to solve the problem noted above, the present invention provides a flat knitting machine with a loop transfer mechanism comprising a pair of front and back needle beds holding needles in such a manner as to freely advance and retract in grooves formed in upper surfaces of the needle beds, at least one of which is movable laterally relative to the other needle bed, and at least one transfer jack bed provided over the at least one needle bed and holding transfer jacks in such a manner as to freely advance and retract in grooves in upper surface of the at least one transfer jack bed, wherein each transfer jack has, on a front end portion thereof, a loop retraining portion which is held in such a manner as to be movable between its lowered position and its raised position in its advanced position on a center line of a needle bed gap between the front and back needle beds; and wherein there is provided transfer jack control means for making such a control that when a loop is transferred from the transfer jack to the needle, the loop retaining portion of the transfer jack put in its advanced position is moved down to its lowered position, first; then, a back side of a needle hook of the needle is made to go into the loop retained on the loop retaining portion of the transfer jack; then the loop retaining portion is raised up to its raised position; and thereafter, a front side of the needle hook of the needle is made to go into the loop. With the construction of the present invention, when the loop is transferred from the TR jack to the needle, the loop retaining portion of the transfer jack put in its advanced position is moved down to its lowered position, first, and, then, the back side of the needle hook goes into the loop retained on the loop retaining portion of the transfer jack. This allows the back side of the needle hook to go into the loop without colliding with the lower yarn portion of the loop crossing beneath the loop retaining portion. Then, after the loop retaining portion is raised up to its raised position, the front side of the needle hook goes into the loop. This allows the front side of the needle hook to go into the loop without colliding with the upper yarn portion of the loop crossing over the loop retaining portion. Thus, in the flat knitting machine of the present invention, the transfer of the loop between the TR jack and the front bed and the transfer of the loop between the TR jack and the back bed is effected through the use of the common track. Also, the loop is lowered in position when the TR jack is retracted from the loop, so that the burden put on the loop is reduced.

It is one of the characteristic feature of the present invention that the transfer jack control means comprises an advancing-and-retracting control cam for controlling the transfer jack so as to be advanced toward and retracted from the center line of the needle bed gap; a clearing cam for controlling the loop retaining portion of the transfer jack put in its advanced position, when the loop is transferred from the transfer jack to the needle, so as to be moved down to its lowered position before the back side of the needle hook of the needle goes into the loop retained on the loop retaining portion of the transfer jack; and a raising cam, located at a rear side of the clearing cam with respect to a moving direction of a carriage when the loop is transferred from the transfer jack to the needle, for raising the loop retaining portion up to its raised position before the front side of the needle hook of the needle goes into the loop. With this construction of the present invention, when the loop is transferred from the TR jack to the needle, the clearing cam acts on the TR jack to push it down so as to push the loop retaining portion down before the back side of the needle hook of the needle goes into the loop, and, then, the raising cam acts on the TR jack to put it up so as to push the loop retaining portion up to its raised position before the front side of the needle hook goes into the loop.

It is one characteristic feature of the present invention that the raised position is set at a position at which an upper yarn portion of the loop retained on the loop retaining portion is located above an advancing-and-retracting track of the front side of the needle hook, and the lowered position is set at a position at which a lower yarn portion of the loop retained on the loop retaining portion is located below an advancing-and-retracting track of the back side of the needle hook. With the construction of the present invention, the needle hook advancing toward the loop is allowed to surely go into the loop without colliding with the lower yarn portion of the loop crossing beneath the loop retaining portion and the upper yarn portion of the loop crossing over the loop retaining portion.

Also, it is one characteristic feature of the present invention that the transfer jack control means comprises the clearing cam, located at a rear side of the raising cam with respect to a traveling direction of the carriage when the loop is transferred from the transfer jack to the needle, for controlling the loop retaining portion so as to be moved down to its lowered position when the TR jack is retracted from the loop. With this construction of the present invention, when the loop is transferred from the TR jack to the lower needle bed, the loop is lowered in position when the TR jack is retracted from the loop received by the needle. This enables the burden put on the loop to be reduced, and as such can provide the smooth transfer of the loop. Also, the TR jack is retracted from the loop in the condition that the loop is moved from the front side of the needle to the back side of the needle. This enables the loop to be reliably retained by the needle hook.

Also, the present invention provides a loop transfer method using a flat knitting machine with a loop transfer mechanism comprising a pair of front and back needle beds holding needles in such a manner as to freely advance and retract in grooves formed in upper surfaces of the needle beds, at least one of which is movable laterally relative to the other needle bed, and at least one transfer jack bed provided over the at least one needle bed and holding transfer jacks in such a manner as to freely advance and retract in grooves formed in upper surface of the at least one transfer jack bed, wherein when a loop is transferred from the transfer jack to the needle, the loop retaining portion of the transfer jack put in its advanced position is moved down to its lowered position, first; then, a back side of a needle hook of the needle is made to go into the loop retained on the loop retaining portion of the transfer jack; then the loop retaining portion is raised up to its raised position; and thereafter, a front side of the needle hook of the needle is made to go into the loop, whereby the needle hook is made to go into the loop retained on the loop retaining portion of the transfer jack.

BRIEF DESCRIPTION OF THE DRAWINGS

FIG. 7-*b* shows a sectional view as taken along an arrowed chain line V—V of FIG. 7-*a*.

FIG. 8-*b* shows the loop retaining portion of the TR jack which is in its raised positions and the needle.

FIG. 9-*b* shows the loop retaining portion of the TR jack which is in its lowered position and the needle.

FIG. 10-*b* shows the loop retaining portion which is in its raised position and the needle.

BEST MODE FOR CARRYING OUT THE INVENTION

Figure 1:
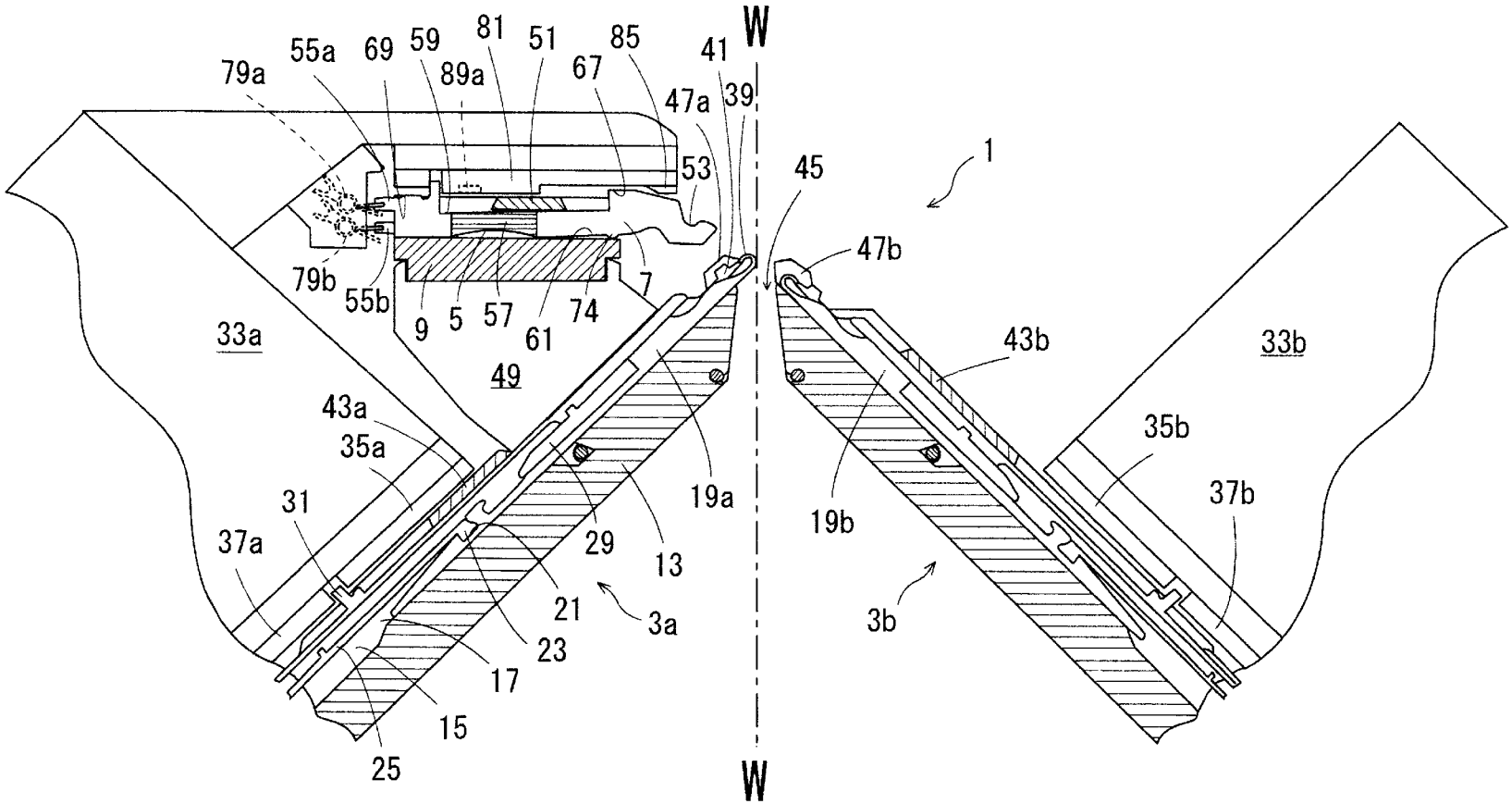
FIG. 1 is a vertical sectional view of a flat knitting machine including a loop transfer mechanism according to an embodiment of the present invention.
Figure 2:
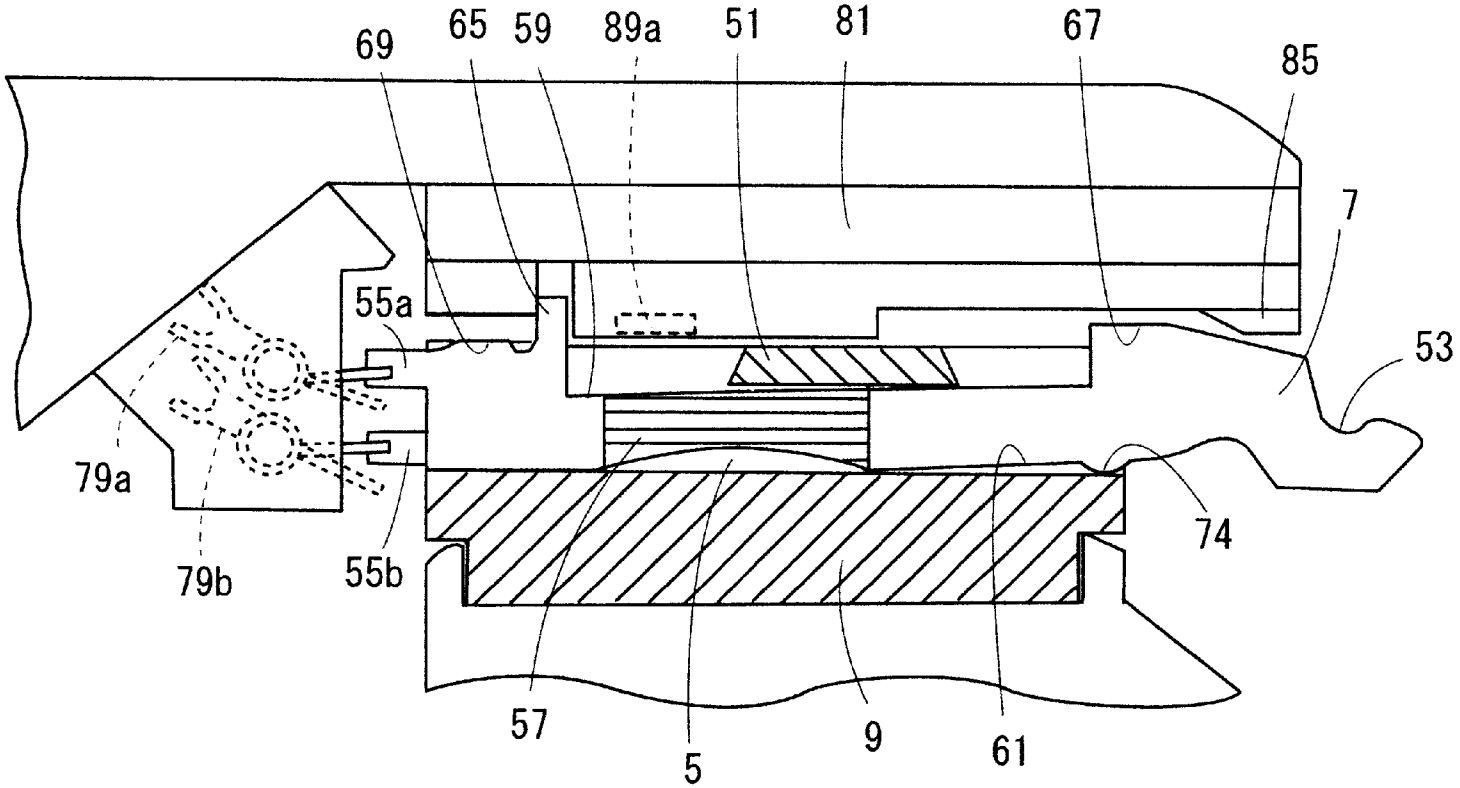
FIG. 2 is a partly enlarged view of FIG. 1.

A certain preferred embodiment of the present invention will be described. First, the construction of the flat knitting machine will be described with reference to FIGS. 1–3. The flat knitting machine 1 comprises a pair of lower beds 3*a*, 3*b* placed opposite in front and back and a TR jack bed 9 placed over the lower front needle bed 3*a* (hereinafter it is simply referred to as the front bed 3*a*) and holding TR jacks 7 in TR jack grooves 5 formed in an upper surface of the TR jack bed. The lower needle beds 3*a*, 3*b* are provided with needle plates 17 standing in the grooves formed on a needle bed base plate 13. Needle grooves 15 are formed between the adjacent needle plates 17, 17, and the needles 19 are held in the needle grooves 15, 15 in such a manner as to be advanced toward a center line W—W of a needle bed gap between the front and back needle beds and retracted therefrom. The back needle bed 3*b* (hereinafter it is simply referred to as the back bed 3*b*) is so structured as to be movable in the longitudinal direction of the needle bed (hereinafter it is expressed as being racked) by means of drive means, not shown.

In the illustrated embodiment, slider needles are used, each being so structured that a needle hook of a needle 19 placed in the needle groove is opened and closed by a butt of a needle jack 25, not shown, having a protrusion 23 to be engaged with a recess 21 formed at the rear end of the needle and a butt 31 of a slider 29 being advanced and retracted via cams 35*a*, 35*b*, 37*a*, 37*b* on a pair of front and back carriages 33*a*, 33*b* which are reversed at each side of the each needle bed. In place of the slider needles, latch needles may be used. The slider 29 is formed by two thin plates being combined in an overlapped relation. When the slider 29 is advanced toward the needle hook 39 of the needle 19, the front end portions of the slider 29 are spread out by the needle hook 39 of the needle 19 to form a loop transfer space in the loop. The loop spread out is retained on a shoulder portion 41 of the slider and is raised up to the loop transfer position. The needle 19 is held in the needle groove 15 via a band 43*a*, 43*b* fitted therein in the longitudinal direction of the needle beds 3*a*, 3*b*. The needle jack 25 is placed in the needle groove, together with a select jack and a selector, not shown, and is so structured that when pressed by a presser of the carriage 33*a*, 33*b* in the direction of being sunk into the needle groove 15, the needle jack causes the butt to move down to a disengaged position from the cam on the carriage 33*a*, 33*b*.

Sinker plates 47*a*, 47*b* are provided between the adjacent needles 19, 19 at the needle bed gap 45 between the front and back needle beds 33*a*, 33*b*. The TR jack bed 9 has the supporting portions formed by upwardly extended portions 49 of the needle plates 17 placed at a specified distance in the front bed 3*a*. The TR jack bed 9 holds the TR jacks 7 in the TR jack grooves 5 formed at the same pitch as the pitch of the needle grooves 15 in the lower needle beds 3*a*, 3*b*. The TR jacks are held in the TR jack bed grooves 5 via the bands 51 fitted therein in the longitudinal direction of the TR jack bed 9. Each TR jack 7 has a loop retaining portion 53 formed at a front end thereof and needle selecting butts 55*a*, 55*b* formed at a rear end thereof. The TR jack 7 is pressed against a side wall of the TR jack groove 5 by a bending portion 57 to prevent the rash action. The TR jack 7 has, on a top surface thereof, an inclined surface 59 which becomes gradually lower in height from the leading end side toward the trail end side and also has, on a bottom surface thereof, an inclined surface 61 which becomes gradually higher toward the leading end, so that when the TR jack 7 is advanced toward the needle bed gap, the TR jack 7 is swingably held in the TR jack groove. The TR jack 7 has, on the top surface, an advancing-and-retracting motion controlling butt 65 having front and back surfaces to abut with the cam so as to act thereon, a clearing cam acting portion 67 provided at a leading end portion of the TR jack 7, and a raising cam acting portion 69 provided at a trailing portion of the same. The bending portion 57 is interposed between the advancing-and-retracting motion controlling butt 65 and the clearing cam acting portion 67. When the clearing cam 85 on the carriage acts on the clearing cam acting portion 67 in the condition in which the loop retaining portion 53 is advanced to a position over the needle bed gap between the front and back needle beds, the TR jack 7 swings in the direction for the loop retaining portion 53 to move downward. When the raising cam 89 acts on the raising cam acting portion 69, the loop retaining portion 53 swings in the direction for the loop retaining portion 53 to move upward. When the TR jack is retracted, the protrusion 74 on the bottom of the TR jack pushes the front end of the TR jack up to its raised position. The TR jacks 7 fall into two groups which are different from each other in the position of the butt 55*a*, 55*b*. Some TR jacks 7 having the butts formed at the same position are bunched together in groups, and these two different groups of TR jacks are arranged alternately every one inch on the TR jack bed 9. These TR jacks 7 selected by selecting means 79*a*, 79*b* disposed in different phases of the carriage with respect to the moving direction of the carriage are advanced toward and retracted from the needle bed gap 45.

TR jack control cams 81 provided in the carriages 33*a*, 33*b* comprise a first cam group 81*a* and a second cam group 81*b*. The first cam group 81*a* acts on the clearing cam acting portion 67 of the TR jack 7, and the second cam group 81*b* acts on the advancing-and-retracting motion controlling butt 65 and the raising cam acting portion 69. The first cam group 81*a* comprises a base portion 83 of small thickness and a clearing cam portion 85 of large thickness. The clearing cam portion 85 comprises two cams, i.e., a first clearing cam 85*a* and a second clearing cam 85*b* which are so arranged as to sandwich a raising cam 89*a* mentioned later therebetween in the moving direction of the carriage. Each of the first clearing cam 85*a* and the second clearing cam 85*b* has inclined surfaces connecting the base portion 83 and the clearing cam surface 85 formed at both ends thereof in the moving direction of the carriage and at a lower end thereof in the advancing and retracting direction of the needle. The clearing cam acting portion 67 of the TR jack 7 is movable along the inclined surface between the base portion 83 and the clearing cam acting portion 85. The second cam portion 81*b* comprises guide cams 87, 89 and 91. A track 93 for the advancing-and-retracting motion controlling butt 65 of the TR jack 7 selected to be in its advanced position is formed between the guide cam 87 and the guide cam 89. A track 95 for the TR jack selected to be in its non-advanced position is formed between the guide cam 89 and the guide cam 91. The raising cam 89*a* of the guide cam 89 has inclined surfaces connecting a base portion 89 of the guide cam 89 and the raising cam portion 89*a* formed at both ends thereof in the moving direction of the carriage 33*a*, 33*b*. The raising cam acting portion 69 is movable along the inclined surface between the base portion 89 and the raising cam portion 89*a*. The raising cam acting portion 69 is provided behind the clearing cam 85*a* with respect to the direction for the carriage to be moved when the loop is transferred from the TR jack to the needle. Needle selection actuators 79*a*, 79*b* each have an acting surface 97*a*, 97*b* which is high at a center portion thereof and low at both ends thereof in the moving direction of the carriage. When the groups of TR jacks 7, 7 used for the loop transfer pass through the needle selection actuators 79*a*, 79*b*, the needle selection actuators are shifted from the inoperative position to the operative position, so that the butts 55*a*, 55*b* are advanced to the track 103 by the acting surfaces 97*a*, 97*b*. When the TR jacks unused for the loop transfer pass through the needle selection actuators, the needle selection actuators 79*a*, 79*b* are held in their inoperative positions, so that those TR jacks pass through the track 101 without being advanced and the clearing cam acting portions 67 of the TR jacks selected to be in their advanced positions are moved along the track 105.

Figure 3:
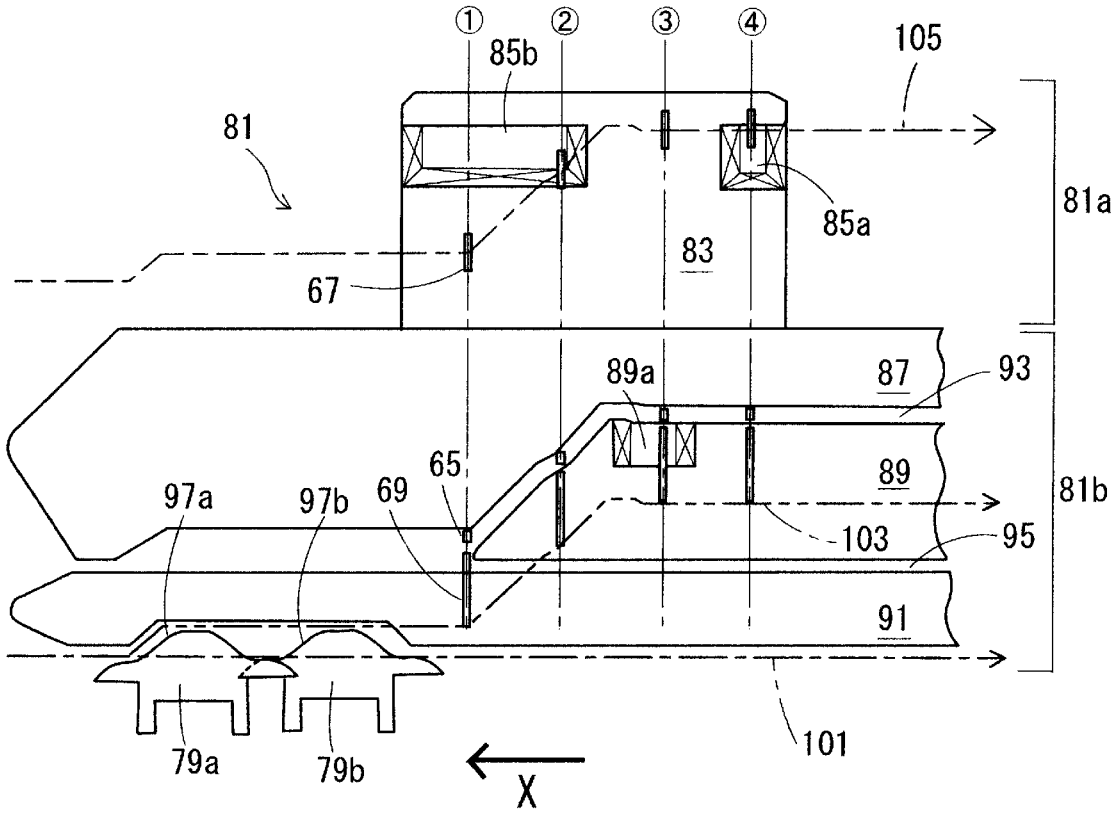
FIG. 3 shows a TR jack control cam system operated when the loop is transferred from the needle to the TR jack, as viewed from bottom.
Figure 4:
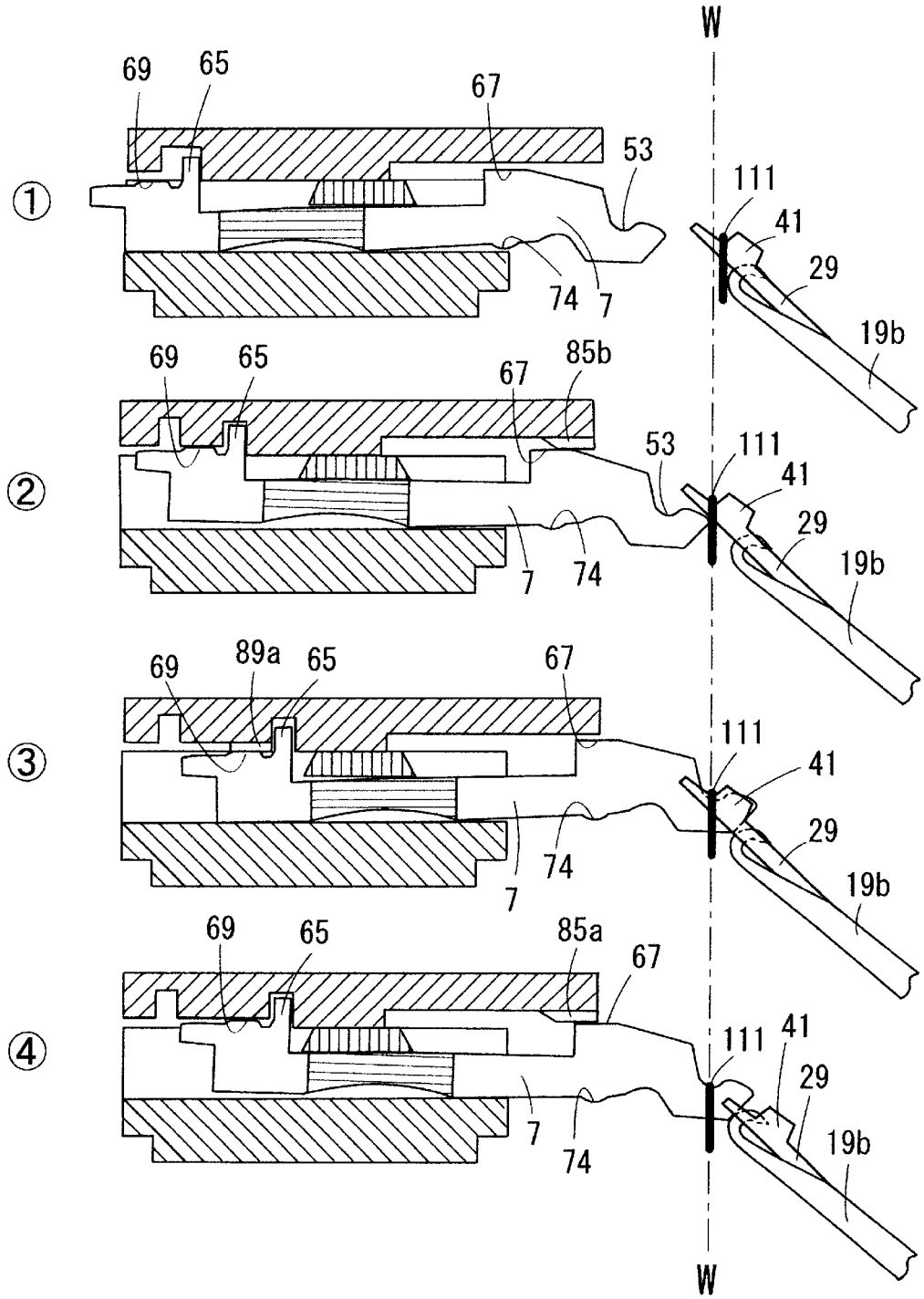
FIG. 4 shows the needle and the TR jack when the TR jacks are in the positions ①–④ of FIG. 3.
Figure 5:
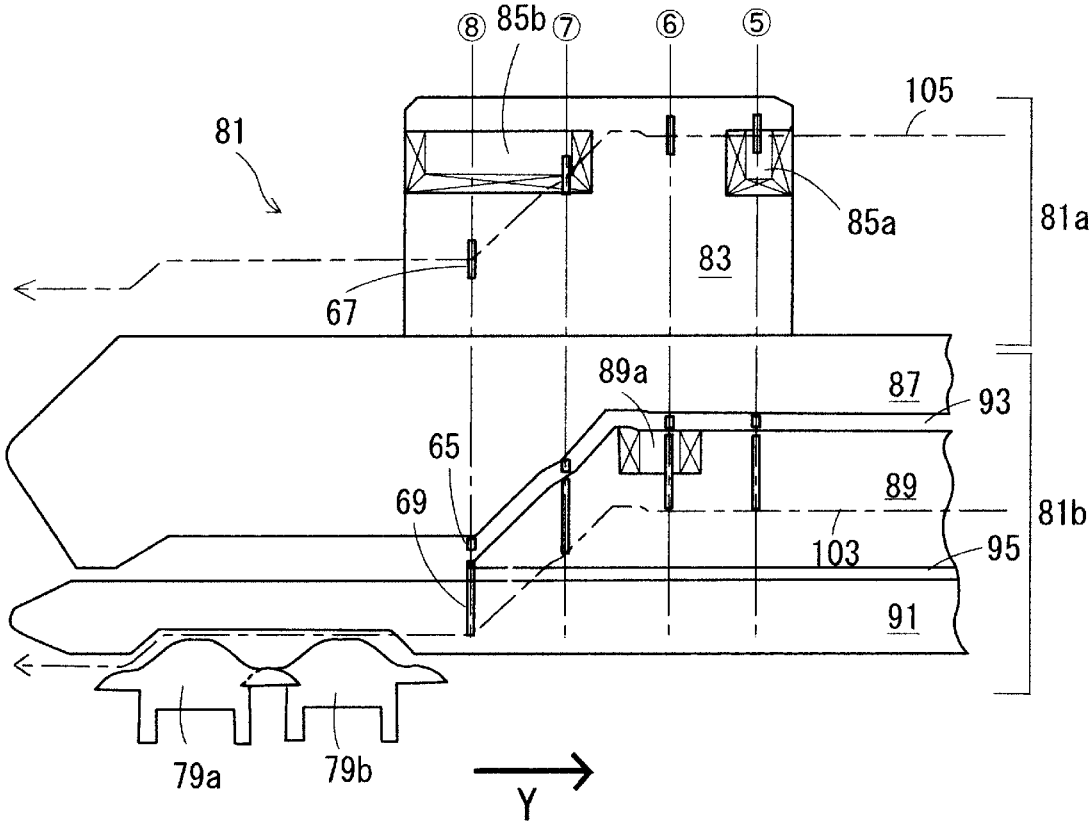
FIG. 5 shows the TR jack control cam operated when the loop is transferred from the TR jack to the needle, as viewed from bottom.
Figure 6:
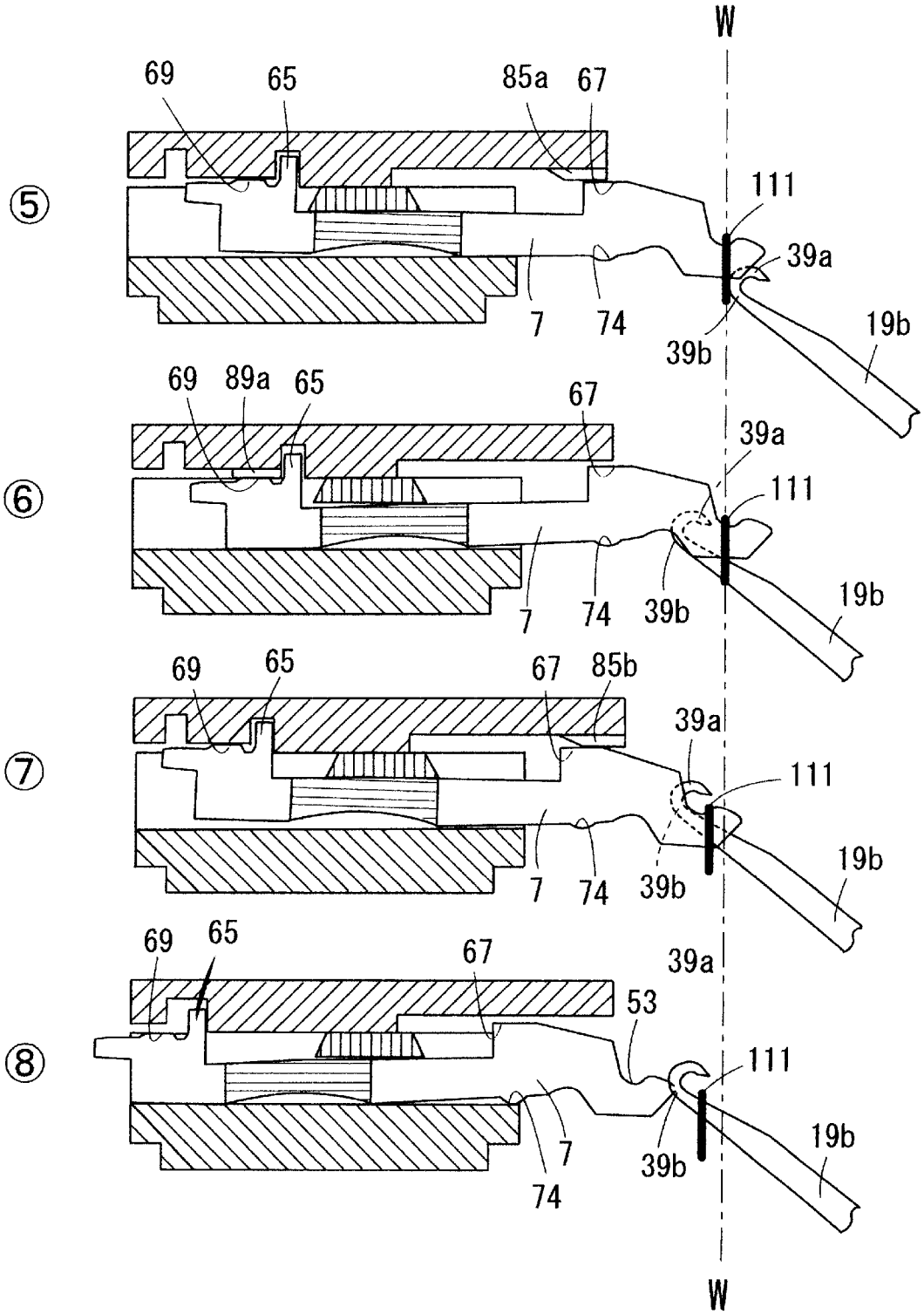
FIG. 6 shows the needle and the TR jack when the TR jack is in the positions ⑤–⑧ of FIG. 5.

With reference to FIGS. 3 and 4, the loop transfer from the needle 19*b* of the back needle bed 3*b* to the TR jack 7 will be described. FIG. 4?–? show the relation between the TR jack 7 and the needle 19*b* when the clearing cam acting portions 67, the advancing-and-retracting motion controlling butt 65 and the raising cam acting portion 69 are in the positions ①–④ in FIG. 3. The arrow X of FIG. 3 indicates the traveling direction of the carriage 33*a*. The clearing cam acting portions 67, the advancing-and-retracting motion controlling butt 65 and the raising cam acting portion 69 are shifted from left to right.

In the following, reference will made to the knitting wherein after the loop retained by the needle 19*b* of the back needle bed 3*b* is transferred to the TR jack, the back bed is racked and then the loop is transferred to the adjacent needle 19*b* of the back bed.

When the TR jack 7 is moved from left to right to the position ① of FIG. 3 in the course in which the loop is transferred, the needle 19*b* from which the loop is transferred is raised up to the loop transfer position after the loop 111 goes out of the needle hook 39 of the needle 19 and is retained on the shoulder 41 of the slider 29. The TR jack 7 to which the loop 111 is transferred starts to advance toward the needle bed gap, with the butts 55*a*, 55*b* of the selected TR jack 7 abutted with the acting surfaces 97*a*, 97*b* of the needle selection actuators 79*a*, 79*b*. In the position ②, the slider 29 of the needle 19*b* is raised up further and also the TR jack 7 is advanced by the guide cams 87, 89. In parallel with this, the second clearing cam 85*a* acts on the clearing cam acting portion 67, so that the TR jack is swung in the clockwise direction in FIG. 3 and is advanced toward the loop 111 in the state in which the loop retaining portion 53 is moved down to its lowered position. In the position ③, the loop retaining portion 53 is advanced to its advanced position and goes into the loop 111. In parallel with this, the raising cam 89*a* acts on the raising cam acting portion 69, so that the TR jack 7 is swung in the counterclockwise direction and the loop retaining portion 53 is raised to its raised position. In the position ④, the needle 19*b* starts to move downwards, so that the loop 111 is transferred from the needle 19*b* to the TR jack 7 and also the loop retaining portion 53 is moved downward again to its lowered position by the first clearing cam 85*a* and passes through the carriage 33*a*, 33*b*, with the loop retaining portion 53 being kept in its lowered position. In the state in which the TR jack is pulled out of the carriage 33*a*, 33*b*, the loop retaining portion 53 of the TR jack is kept in its lowered position until the carriage 33*a*, 33*b* is reversed in the sequent knitting and the loop is transferred from the TR jack to the needle.

Figure 7:
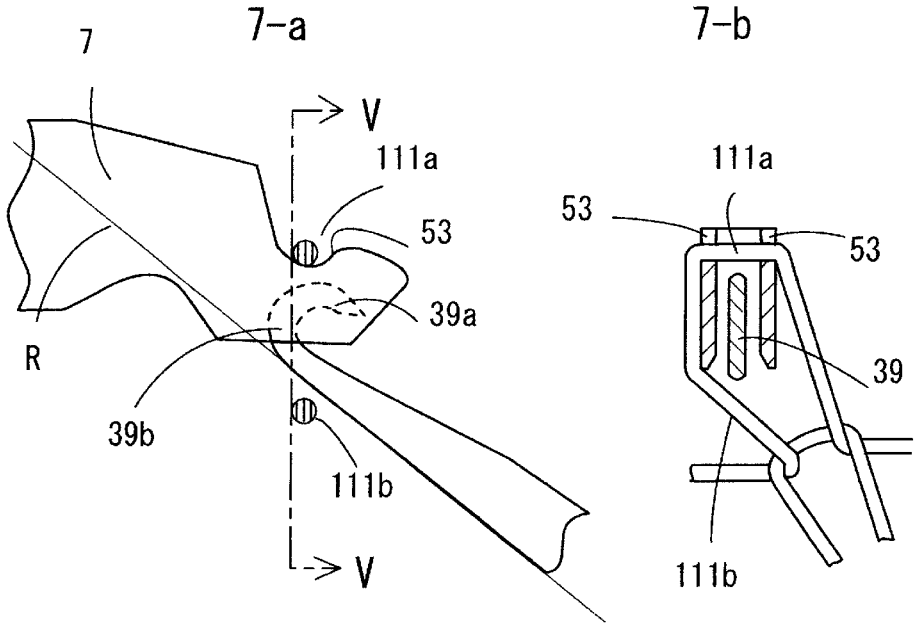
FIG. 7-*a* shows front end portions of the TR jack and the needle which are in their lowered positions.

Next, reference will made to the loop transfer from the TR jack 7 to the needle 19*b* of the back bed 3*b* with reference to FIGS. 5–9. After completion of the loop transfer from the needle 19*b* of the back bed 3*b* to the TR jack 7, the back bed 13*b* is racked. Sequentially, the carriages 33*a*, 33*b* are reversed and start to travel in the direction indicated by the arrow Y. When the TR jack 7 reaches the position ⑤ of FIG. 5, the loop retaining portion 53 of the TR jack 7 is kept in its lowered position, with the loop retaining portion 53 advanced onto the center line W—W of the needle bed gap. The needle 19*b* to receive the loop 111 starts to advance, so that the needle hook 39 is advanced into the space formed by the loop 111 and the slider 29. At this time, the loop 111 retained by the TR jack is pulled laterally by the racking of the bed, as shown in FIG. 7, and an upper yarn portion 111*a* and a lower yarn portion 111*b* of the loop 111 cross over and beneath the loop retaining portion 53, respectively. In order for the loop 111 to be retained by the needle hook 39, the needle hook 39 need be made to go into the loop in such a manner that the upper yarn portion 111*a* of the loop can be located at the front side of the needle 19*b* and the lower yarn portion 111*b* of the loop can be located at the back side of the needle 19*b*. Accordingly, it is preferable that the lowered position of the TR jack is set to be lower than the straight line R indicating the advancing-and-retracting track of the back side of the needle 19*b*. Even when the lowered position of the TR jack is higher than the straight line R, such a position of the TR jack is tolerable, as long as such a position can prevent the lower yarn portion 111*b* of the loop abutted with the tip of the hook of the needle 19*b* from being located at the front side of the needle.

In the position ⑥, the raising cam 89*a* acts on the raising cam acting portion 69, so that the TR jack 7 is swung in the counterclockwise direction and the loop retaining portion 53 of the TR jack 7 is raised from its lowered position to its raised position, to allow the needle hook 39 of the needle 19*b* to go into the loop 111 without contacting with the loop 111. It is preferable that the raised position of the loop retaining portion 53 is set to be higher than the advancing-and-retracting track of the front side of the front side 39*a* of the needle hook 39 of the needle 19*b* that advances toward the loop 111. Even when the raised position of the loop retaining portion 53 is lower than the advancing-and-retracting track, such a position of the loop retaining portion 53 is tolerable, as long as such a position can prevent the lower yarn portion 111*b* of the loop abutted with the needle hook 39 of the needle 19*b* from being located at the back side of the needle 19*b*. In the position ⑦, the TR jack 7 starts to be retracted by the guide cam 87, 89. Then, the second clearing cam 85*b* acts on the clearing cam acting portion 67 of the TR jack 7, so that the TR jack is swung in the counterclockwise direction. As a result of this, the loop 111 is lowered to the lowered position lower than the track of the back side 39*b* of the needle hook 39 of the needle 19*b*, and as such can allow the loop 111 to be surely retained by the needle hook 39. In the position ⑧, the TR jack 7 is retracted further and the protrusion 74 of the TR jack 7 is brought into contact with an upper surface of the TR jack groove 5 to put the loop retaining portion 53 of the TR jack 7 back to the raised position. As a result of this, the loop 111 is released from the TR jack 7, with which the loop transfer from the TR jack 7 to the needle 19*b* is completed.

Figure 8:
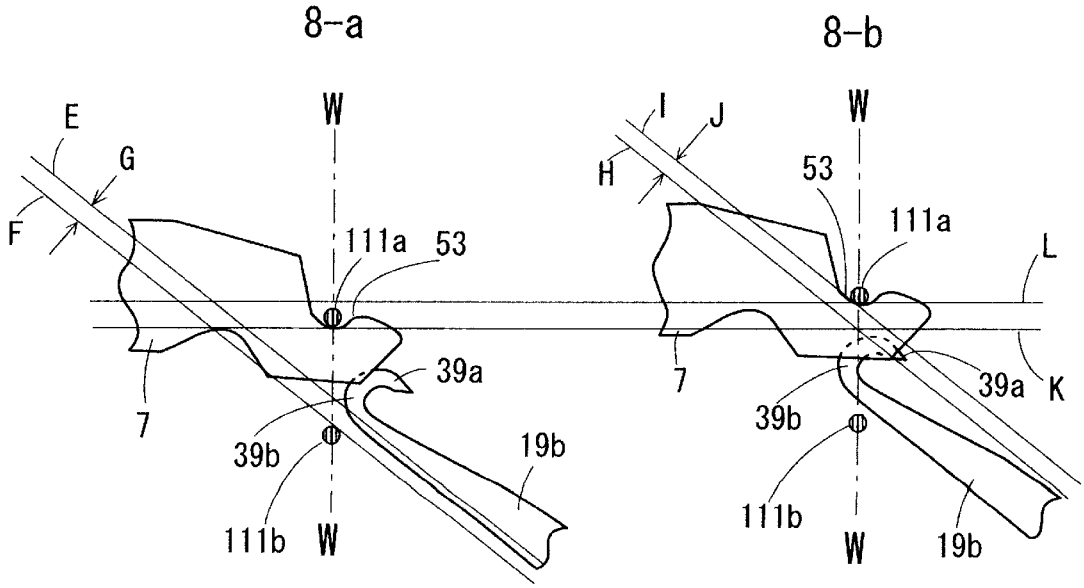
FIG. 8-*a* shows a loop retaining portion of the TR jack which is in its lowered position and the needle when the loop is transferred from the TR jack to the needle 19*b* of the back needle bed 3*b*.

As mentioned above, in the flat knitting machine 1 of the illustrated embodiment, when the loop is transferred from the TR jack 7 to the needle 19*b*, as shown in FIG. 8-*a*, the loop retaining portion 53 is moved down to its lowered position, first, and, then, the back side 39*b* of the needle 19*b* goes into the loop 111. As a result of this, the back side 39*b* of the needle 19*b* goes into the loop 111 in the condition in which the lower yarn portion 111*b* of the loop 111 crossing beneath the loop retaining portion 53 is moved toward the back side 39*b* of the needle hook to the extent corresponding to the interval G defined by a straight line E parallel with the advancing-and-retracting track of the needle 19*b* passing through the lower yarn portion 111*b* of the loop 111 when the loop retaining portion 53 is in its raised position and a straight line F parallel with the advancing-and-retracting track of the needle 19*b* passing through the lower yarn portion 111*b* of the loop 111 when the loop retaining portion 53 is in its lowered position. Thus, the back side 39*b* of the needle 19*b* is prevented from colliding with the lower yarn portion 111*b* of the loop 111 crossing beneath the loop retaining portion 53. Sequentially, as shown in FIG. 8-*b*, after the loop retaining portion 53 is raised up to its raised position, the front side 39*a* of the needle goes into the loop 111. As a result of this, the front side 39*a* of the needle 19*a* goes into the loop 111 in the condition in which the upper yarn portion 111*a* of the loop 111 crossing over the loop retaining portion 53 is moved toward the front side 39*a* of the needle hook to the extent corresponding to the interval J defined by a straight line H parallel with the advancing-and-retracting track of the back side 39*b* of the needle hook of the needle 19*b* passing through the upper yarn portion 111*a* of the loop 111 when the loop retaining portion 53 is in its lowered position and a straight line I parallel with the advancing-and-retracting track of the back side 39*b* of the needle hook of the needle 19*b* passing through the loop when the loop retaining portion 53 is in its raised position. Thus, the front side 39*a* of the needle 19*b* is prevented from colliding with the upper yarn portion 111*a* of the loop 111 crossing over the loop retaining portion 53. If the loop transfer from the TR jack to the needle is performed by moving the TR jack 7 back or forth from the center line of the needle bed gap so that the yarn portion of the loop crossing over or beneath the loop retaining portion can be moved to the front side or the back side of the needle hook, there is the possibility that the adjacent loops retained on the TR jacks may be out of position in front and back to be pulled each other and, as a result, the loop may be slipped off from the loop retaining portion. In contrast to this, in the flat knitting machine of the embodiment of the present invention, since the yarn portion of the loop is moved to the front side or the back side of the needle by the vertical movement of the TR jack on the center line of the needle bed gap, there is no possibility of the loop being slipped off from the loop retaining portion. It is to be noted that the line K is a horizontal straight line passing through the upper yarn portion 111*a* of the loop when the loop retaining portion 53 is in its lowered position, and the line L is a horizontal straight line passing through the upper yarn portion 111*a* of the loop when the loop retaining portion 53 is in its raised position.

Figure 9:
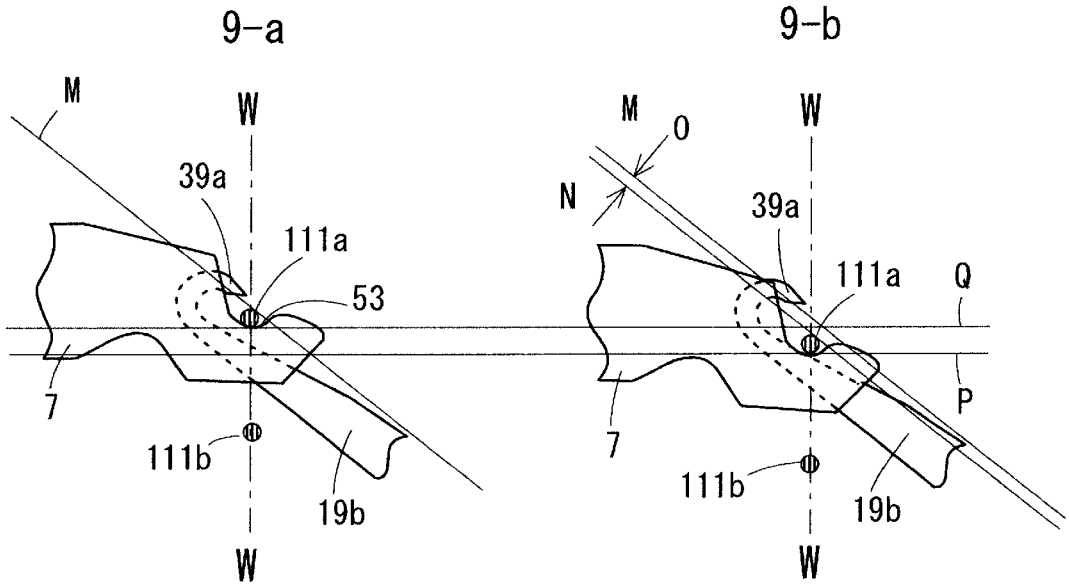
FIG. 9-*a* shows the loop retaining portion of the TR jack which is in its raised position and the needle when the loop is transferred from the TR jack to the needle of the back needle bed.

When the TR jack is retracted from the loop transferred from the TR jack to the needle, the loop retaining portion 53 is moved down to its lowered position shown in FIG. 9-*b* from its raised position shown in FIG. 9-*a* by the clearing cam 85*b*. As a result of the loop retaining portion 53 being put in its lowered position, the burden put on the loop 111 when the loop 111 is pulled out of the loop retaining portion 53 can be reduced, and as such can allow the loop to be transferred smoothly. In addition, the needle 19*b* is lowered in the condition in which the loop is moved to the back side 39*b* of the needle 19*b* to the extent corresponding to the interval O defined by a straight line M parallel with the advancing-and-retracting track of the front side 39*a* of the needle hook of the needle 19*a* passing through the upper yarn portion 111*a* of the loop 111 crossing over the loop retaining portion 53 when put in its raised position and a straight line N parallel with the advancing-and-retracting track of the front side 39*a* of the needle hook of the needle 19*b* passing through the upper yarn portion 111*a* of the loop 111 when the loop retaining portion 53 is in its lowered position. This enables the needle hook 39 to be surely engaged with the loop 111 to prevent occurrence of the drop stitch. It is to be noted that the line P is a horizontal straight line passing through the upper yarn portion 111*a* of the loop when the loop retaining portion 53 is in its lowered position, and the line Q is a horizontal straight line passing through the upper yarn portion 111*a* of the loop when the loop retaining portion 53 is in its raised position.

Figure 10:
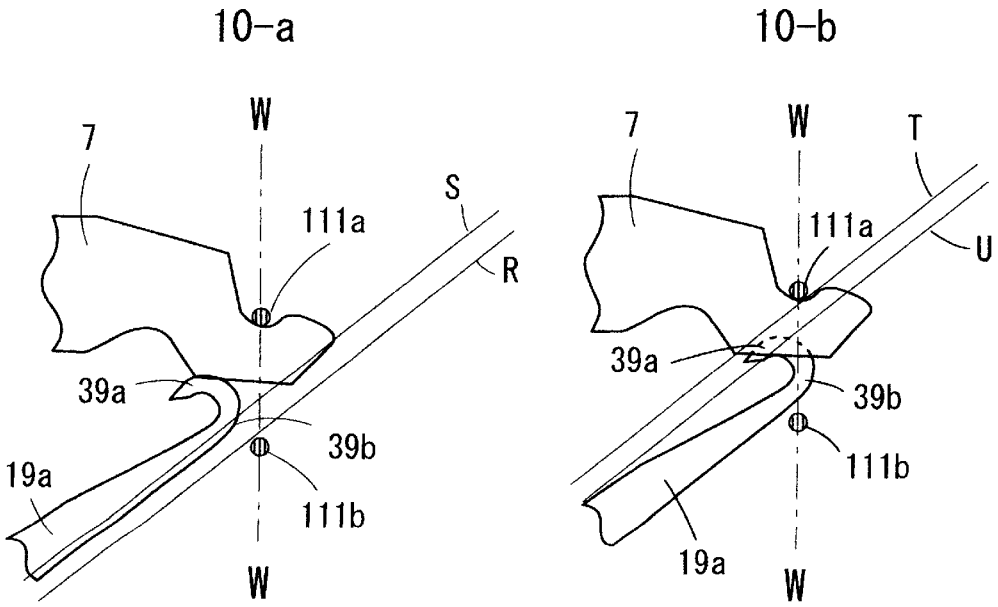
FIG. 10-*a* shows the loop retaining portion of the TR jack which is in its lowered position and the needle when the loop is transferred from the needle of the front bed to the TR jack.

Although reference has been made to the loop transfer between the TR jack 7 and the back bed 13*b* in the illustrated embodiment, since the same track is used for the transfer of the loop 111 between the TR jack 7 and the needle 19*a* of the front bed 13*a* as well as for the transfer of the loop 111 between the TR jack 7 and the needle of the back bed 13*b*, there is no need to separately provide the track for the transfer of the loop between the TR jack 7 and the needle of the front bed 13*a* and the track for the transfer of the loop between the TR jack 7 and the needle of the back bed 13*b*. This can provide a simplified construction of the device and a reduced length of the device in the moving direction of the carriage, as compared with the case where there are separately provided the track for the front bed and the track for the back bed. FIG. 10-*a* and FIG. 10-*b* are drawing figures correspond to FIG. 8-*a* and FIG. 8-*b*. FIG. 10-*a* shows the TR jack 7 and the needle 19*a* when the front side 39*a* of the needle hook of the needle 19*a* goes into the loop 111 in the loop transfer from the TR jack bed to the front bed 3*a*. FIG. 10-*b* shows the TR jack 7 and the needle 19*a* when the front side 39*a* of the needle hook of the needle 19*a* goes into the loop. A line R is a straight line parallel with the advancing-and-retracting track of the back side of the needle hook 39*b* of the needle 19*b* passing through the lower yarn portion 111*b* of the loop when the loop retaining portion is in its lowered position. A straight line S is a straight line parallel with the advancing-and-retracting track of the back side 39*b* of the needle hook of the needle 19*b* passing through the lower yarn portion 111*b* of the loop when the loop retaining portion 53 is in its raised position. A line T is a straight line parallel with the advancing-and-retracting track of the front side 39*a* of the needle hook of the needle 19*b* passing through the upper yarn portion 111*a* of the loop when the loop retaining portion 53 is in its raised position. A straight line U is a straight line parallel with the advancing-and-retracting track of the front side 39*a* of the needle hook of the needle 19*a* passing through the upper yarn portion 111*a* of the loop when the loop retaining portion 53 is in its raised position. Though not shown but described with reference to FIG. 9, the operation and effect produced by the construction that when the needle is moved downward, the loop retaining portion is put in its lowered position so that the loop can be surely retained by the needle hook can also be produced in the loop transfer from the TR jack bed 9 to the needle 19*a* of the front bed 13*a* located under the TR jack bed.

While in the embodiment illustrated above, the flat knitting machine including the fixed sinkers is taken as an example, the present invention can be practicable in the flat knitting machine including movable sinkers. Also, the TR jack bed, which is provided over the front bed 3*a* in the embodiment illustrated above, may be provided over the back bed 3*b* as well. The clearing cam 85 and the raising cam 89, which are constructed by the fixed cams in the embodiment illustrated above, may be constructed by movable cams such as retractable cams. Further, the TR jack control means, which is constructed by the raising cam and the clearing cam in the embodiment illustrated above, may be constructed by biasing means for always biasing the loop retaining portion of the TR jack toward the raised position and a clearing cam for pushing the loop retaining portion down to the lowered position against a biasing force of that biasing means or by biasing means for always biasing the loop retaining portion of the TR jack toward the lowered position and a raising cam for pushing the loop retaining portion up to the raised position. The components of the flat knitting machine of the illustrated embodiment may be varied in construction in this sense.

Capabilities of Exploitation in Industry

As mentioned above, according to the present invention, when the loop is transferred from the TR jack to the needle, the back side of the needle hook is allowed to go into the loop retained on the loop retaining portion of the TR jack without colliding with the yarn portion of the loop crossing beneath the loop retaining portion of the TR jack and also the front side of the needle hook is allowed to go into the loop without colliding with the yarn portion of the loop crossing over the loop retaining portion of the TR jack. Thus, the loop transfer can be ensured by simply providing the common track for the needles of the front needle bed and the needles of the back needle beds.

What is claimed is:

1. A flat knitting machine with a loop transfer mechanism comprising a pair of front and back needle beds holding needles in such a manner as to freely advance and retract in grooves formed in upper surfaces of the needle beds, at least one of which is movable laterally relative to the other needle bed, and at least one transfer jack bed provided over the at least one needle bed and holding transfer jacks in such a manner as to freely advance and retract in grooves in upper surface of the at least one transfer jack bed, wherein each transfer jack has, on a front end portion thereof, a loop retraining portion which is held in such a manner as to be movable between its lowered position and its raised position in its advanced position on a center line of a needle bed gap between the front and back needle beds; and wherein there is provided transfer jack control means for making such a control that when a loop is transferred from the transfer jack to the needle, the loop retaining portion of the transfer jack put in its advanced position is moved down to its lowered position, first; then, a back side of a needle hook of the needle is made to go into the loop retained on the loop retaining portion of the transfer jack; then the loop retaining portion is raised up to its raised position; and thereafter, a front side of the needle hook of the needle is made to go into the loop.

2. The flat knitting machine with the loop transfer mechanism according to claim 1, wherein the transfer jack control means comprises:

an advancing-and-retracting control cam for controlling the transfer jack so as to be advanced toward and retracted from the center line of the needle bed gap;

a clearing cam for controlling the loop retaining portion of the transfer jack put in its advanced position, so as to be moved down to its lowered position before the back side of the needle hook of the needle goes into the loop retained on the loop retaining portion of the transfer jack; and a raising cam, located at a rear side of the clearing cam with respect to a moving direction of a carriage when the loop is transferred from the transfer jack to the needle, for raising the loop retaining portion up to its raised position before the front side of the needle hook of the needle goes into the loop.

3. The flat knitting machine with the loop transfer mechanism according to claim 1, wherein the raised position is set at a position at which an upper yarn portion of the loop retained on the loop retaining portion is located above an advancing-and-retracting track of the front side of the needle hook, and the lowered position is set at a position at which a lower yarn portion of the loop retained on the loop retaining portion is located below an advancing-and-retracting track of the back side of the needle hook.

4. The flat knitting machine with the loop transfer mechanism according to claim 1, wherein the transfer jack control means comprises the clearing cam, located at a rear side of the raising cam with respect to a traveling direction of a carriage when the loop is transferred from the transfer jack to the needle, for controlling the loop retaining portion so as to be moved down to its lowered position when the TR jack is retracted from the loop.

5. A loop transfer method using a flat knitting machine with a loop transfer mechanism comprising a pair of front and back needle beds holding needles in such a manner as to freely advance and retract in grooves formed in upper surfaces of the needle beds, at least one of which is movable laterally relative to the other needle bed, and at least one transfer jack bed provided over the at least one needle bed and holding transfer jacks in such a manner as to freely advance and retract in grooves formed in upper surface of the at least one transfer jack bed, wherein when a loop is transferred from the transfer jack to the needle, the loop retaining portion of the transfer jack put in its advanced position is moved down to its lowered position, first; then, a back side of a needle hook of the needle is made to go into the loop retained on the loop retaining portion of the transfer jack; then the loop retaining portion is raised up to its raised position; and thereafter, a front side of the needle hook of the needle is made to go into the loop, whereby the needle hook is made to go into the loop retained on the loop retaining portion of the transfer jack.

* * * * *